US008032055B2

(12) United States Patent
Terai

(10) Patent No.: US 8,032,055 B2
(45) Date of Patent: Oct. 4, 2011

(54) DEVELOPING DEVICE, PROCESS CARTRIDGE INCLUDING DEVELOPING DEVICE, AND IMAGE FORMING APPARATUS INCLUDING PROCESS CARTRIDGE

(75) Inventor: Junichi Terai, Isehara (JP)

(73) Assignee: Ricoh Company, Ltd., Tokyo (JP)

( * ) Notice: Subject to any disclaimer, the term of this patent is extended or adjusted under 35 U.S.C. 154(b) by 510 days.

(21) Appl. No.: 12/182,626

(22) Filed: Jul. 30, 2008

(65) Prior Publication Data

US 2009/0067877 A1 Mar. 12, 2009

(30) Foreign Application Priority Data

Aug. 8, 2007 (JP) ..... 2007-207236

(51) Int. Cl.
*G03G 21/16* (2006.01)

(52) U.S. Cl. ..... 399/111

(58) Field of Classification Search ..... 399/111
See application file for complete search history.

(56) References Cited

U.S. PATENT DOCUMENTS

| | | | |
|---|---|---|---|
| 5,051,760 | A | 9/1991 | Shoji et al. |
| 5,848,326 | A | 12/1998 | Komuro et al. |
| 6,337,957 | B1 | 1/2002 | Tamaki et al. |
| 6,522,855 | B1 | 2/2003 | Katoh et al. |
| 6,681,092 | B2 | 1/2004 | Terai |
| 6,757,510 | B2 | 6/2004 | Terai |
| 6,985,165 | B2 | 1/2006 | Terai |
| 7,043,182 | B2 | 5/2006 | Sakai et al. |
| 7,289,755 | B2 | 10/2007 | Terai |
| 2008/0175628 | A1 | 7/2008 | Kita et al. |

FOREIGN PATENT DOCUMENTS

| | | | |
|---|---|---|---|
| JP | 62231975 | A * | 10/1987 |
| JP | 01234871 | A * | 9/1989 |
| JP | 05303272 | A * | 11/1993 |
| JP | 2001-134069 | | 5/2001 |
| JP | 2004-21122 | | 1/2004 |

OTHER PUBLICATIONS

U.S. Appl. No. 12/019,984, filed Jan. 25, 2008, Kiyonori Tsuda et al.
U.S. Appl. No. 12/020,713, filed Jan. 28, 2008, Keiko Matsumoto et al.

* cited by examiner

*Primary Examiner* — David Gray
*Assistant Examiner* — Erika J Villaluna
(74) *Attorney, Agent, or Firm* — Oblon, Spivak, McClelland, Maier & Neustadt, L.L.P.

(57) ABSTRACT

A developing device includes a developer bearing member and a shock absorbing member. The developer bearing member includes a developing region across from an image bearing member including an image forming region, and a center portion including an image creating region corresponding to the image forming region on the image bearing member. The developer bearing member is configured to bear the developer on the surface thereof and transport the developer to the developing region while moving the surface. The shock absorbing member is provided to each of both ends of the developer bearing member in a width direction thereof across from the image bearing member. Each of both ends of the developer bearing member is provided outside the center portion of the developer bearing member, and an outer diameter of each of both ends of the developer bearing member is substantially smaller than an outer diameter of the center portion.

13 Claims, 11 Drawing Sheets

DEVELOPING DEVICE, PROCESS CARTRIDGE INCLUDING DEVELOPING DEVICE, AND IMAGE FORMING APPARATUS INCLUDING PROCESS CARTRIDGE

CROSS-REFERENCE TO RELATED APPLICATIONS

This patent application is based on and claims priority pursuant to 35 U.S.C. §119 from Japanese Patent Application No. 2007-207236 filed on Aug. 8, 2007 in the Japan Patent Office, the entire contents of which are hereby incorporated herein by reference.

BACKGROUND OF THE INVENTION

1. Field of the Invention

Exemplary aspects of the present invention generally relate to a developing device, a process cartridge including the developing device, and an image forming apparatus including the process cartridge.

2. Description of the Background Art

Conventionally, a developing device equipped with a developing sleeve serving as a developer bearing member having a surface including a plurality of recessed portions for assuring stable developer conveyance is known as a developing device used in image forming apparatuses such as a copier, a facsimile, a printer, and a plotter.

For example, as disclosed in Japanese Patent Unexamined Application Publication No. 2001-134069, a developing device includes a developing sleeve having a plurality of grooves serving as recessed portions extending in an axial direction and provided on a peripheral surface in a circumferential direction of the developing sleeve.

Another known developing device includes a developing sleeve, the peripheral surface of which is sandblasted or otherwise surface-finished so as to have a coarse surface including a plurality of recessed portions.

A developing sleeve including the plurality of grooves or the recessed portions formed on the peripheral surface by sandblasting or other surface finishing is able to consistently bear the developer, thereby stabilizing an amount of the developer that is borne on the peripheral surface of the developing sleeve and passes a regulating position at which a developer regulating member further regulates and refines the amount of developer.

However, the following problems may occur in a developing sleeve, the surface of which either includes the grooves described above or is subjected to surface finish such as sandblasting.

FIG. 14A is a cross-sectional view illustrating a developing sleeve and a photoreceptor, according to a related art, and FIG. 14B is a side view illustrating a supporting plate including shaft bearings illustrated in FIG. 14A, according to a related art.

With reference to FIGS. 14A and 14B, according to Japanese Patent Unexamined Application Publication No. 2004-21122, for example, relatively large amounts of developer are borne at both end portions of a developing sleeve 750 in a width direction of an image creating region of the developing sleeve 750, and are transported to a developing region (nip portion) of the developing sleeve 750 across from a photoreceptor 800 serving as an image bearing member.

Consequently, developer density rises at each of both ends of the image creating region in the width direction of the developer sleeve, thereby intensifying pressure on the developer between the photoreceptor 800 and the developing sleeve 750.

As a result, the developer may firmly stick to the surface of the developing sleeve and/or the developer may drop from each of both ends of the developer sleeve. When the developer firmly sticks to the surface of both ends of the developer sleeve, problems such as peeling of the surface layer of the photoreceptor, background contamination of an image, banding due to an increase or fluctuation in operational load, and cleaning failure may occur in the image forming apparatus.

In particular, according to Japanese Patent Unexamined Application Publication No. 2004-21122, when a developer consisting of small-diameter particles is used and/or a developing gap between the photoreceptor 800 and the developing sleeve 750 is reduced in order to achieve better imaging quality, the developer is likely to stick firmly to each of both ends of the developing sleeve.

In an attempt to reduce, if not prevent entirely, the problems described above, according to Japanese Patent Unexamined Application Publication No. 2004-21122, an outer diameter of the developing sleeve is deliberately made smaller at each of both ends thereof. That is, the outer diameter of the developing sleeve is less than that of a center portion of the developing sleeve, so that the overall shape of the sleeve is such that the sleeve bulges slightly at the middle and tapers toward both ends.

However, because the outer diameter of the developing sleeve is reduced at both ends, a difference in height or a step is formed at each of both ends of the developing sleeve. The step portion at both ends may damage the photoreceptor when the step portion comes into contact with the photoreceptor. Furthermore, upon assembly, mounting, and transport, the developing sleeve may contact the photoreceptor, thereby damaging the photoreceptor and thus causing image failure.

In order to achieve high image quality and reduce irregular image density, a developing space or gap Gp between the developing sleeve 750 and the photoreceptor 800 needs to be relatively small, and the size of such small gap needs to be maintained accurately and consistently.

In order to obtain such a gap, in the related art image forming apparatus, after installation of the developing sleeve or the developing unit in the image forming apparatus, a pair of plate members (similar to plate members 101 and 102 in FIG. 4) is affixed to both front and rear ends of the developing sleeve and the photoreceptor so as to fix the positions of the developing sleeve and the photoreceptor.

However, there is a problem with such an approach, in that the developing sleeve may contact the photoreceptor before the plate members are installed at both ends, thereby damaging the photoreceptor.

Consequently, as illustrated in FIG. 15, which is a conceptual diagram illustrating a plan view of a method for positioning the developing sleeve and the photoreceptor of FIG. 14 according to the related art, a main frame 210 of the image forming apparatus main body is typically provided with a shaft 211 which is inserted into an insertion hole 800*b* of the photoreceptor 800 so as to fix the photoreceptor 800 in place and maintain the gap Gp between the developing sleeve 750 and the photoreceptor 800 at a predetermined size. A more detailed description of this arrangement follows.

In FIGS. 14 and 15, a PCU unit 500 including a developing device equipped with the photoreceptor 800 and the developing sleeve 750 is illustrated. The PCU 500 is detachable from the main frame 210 of the image forming apparatus.

As illustrated in FIGS. 14 and 15, the photoreceptor 800 is a hollow-type photoreceptor. Shaft bearings 280 rotatably support a shaft 752 provided to both end portions 751 of the developing sleeve 750. The end portions 751 of the developing sleeve 750 are provided outside the image forming region of the photoreceptor 800. The outer diameter of the end portions 751 is smaller than the outer diameter of the center portion of the developing sleeve 750.

Shaft bearings 281 rotatably support the shaft 211 which is inserted into the insertion hole 800*b* of the photoreceptor 800. The shaft bearings 280 and the shaft bearings 281 are provided to supporting plates 105 and 106 so as to position the developing sleeve 750 and the photoreceptor 800.

As illustrated in FIG. 15, the PCU unit 500 is moved in a direction indicated by a hollow arrow to be mounted on the main frame 210 of the image forming apparatus so that the shaft 211 is inserted into the shaft bearings 281 and then inserted into the insertion hole 800*b* of the photoreceptor 800.

A problem arises here, in that a biasing force of a spring, not shown, pressing a tip of a cleaning blade 275 (similar to a cleaning blade 75 shown in FIG. 12) against the surface of the photoreceptor 800 causes the photoreceptor 800 to move to the left as indicated by a small solid arrow. Consequently, the shaft 211 may be misaligned, by an amount indicated by reference numeral 215, for example.

In order to insert the shaft 211 into the insertion hole 800*b* of the photoreceptor 800, the PCU unit 500 needs to be moved laterally left and right to align the shaft 211 with the insertion hole 800*b*. Consequently, inertia or the like occurs in the photoreceptor 800 so that a predetermined gap Gp between a surface 800*a* of the photoreceptor 800 and the surface of the developing sleeve 750 cannot be secured, and thus, an edge portion of the step portion of the developing sleeve 750 having a smaller diameter than the center portion thereof may contact the surface of the photoreceptor 800, thereby damaging the surface of the photoreceptor 800.

Still further, upon transport of the image forming apparatus in a state illustrated in FIG. 4, for example, when vibration, shock, or the like is applied, there is a possibility that the developing sleeve 750 and the photoreceptor 800 may contact each other. This is especially the case when the gap Gp is configured to be relatively small so as to achieve high quality imaging, and as a consequence inadvertent contact between the developing sleeve 750 and the photoreceptor 800 occurs more readily.

Still further, when packing a process cartridge, a container is likely small so that the photoreceptor 800 may be easily affected by vibration and shock during transportation. It is to be noted that the hollow-type photoreceptor 800 without a shaft tends to be affected easily by vibration and shock.

SUMMARY OF THE INVENTION

Exemplary embodiments of the present invention provide a developing device including a developer bearing member and a shock absorbing member. The developer bearing member includes a developing region across from an image bearing member including an image forming region, and a center portion including an image creating region corresponding to the image forming region of the image bearing member. The developer bearing member is configured to bear the developer on the surface thereof and transport the developer to the developing region while moving the surface. The shock absorbing member is provided to each of both ends of the developer bearing member in a width direction thereof across from the image bearing member. Each of both ends of the developer bearing member is provided outside the center portion of the developer bearing member, and an outer diameter of each of both ends of the developer bearing member is substantially smaller than an outer diameter of the center portion.

According to another preferred embodiment of the present invention, an image forming apparatus includes an image bearing member configured to bear a latent image on a surface thereof, a latent image forming device configured to form the latent image on the image bearing member, a transfer device configured to transfer a toner image on the image bearing member onto a transfer medium and the developing device.

According to still another preferred embodiment of the present invention, a process cartridge detachable from the image forming apparatus is provided. The process cartridge includes at least an image bearing member configured to bear a latent image on a surface thereof and the developing device.

Additional features and advantages of the present invention will be more fully apparent from the following detailed description of exemplary embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of exemplary embodiments when considered in connection with the accompanying drawings, wherein.

DETAILED DESCRIPTION OF EXEMPLARY EMBODIMENTS

Figure 1:
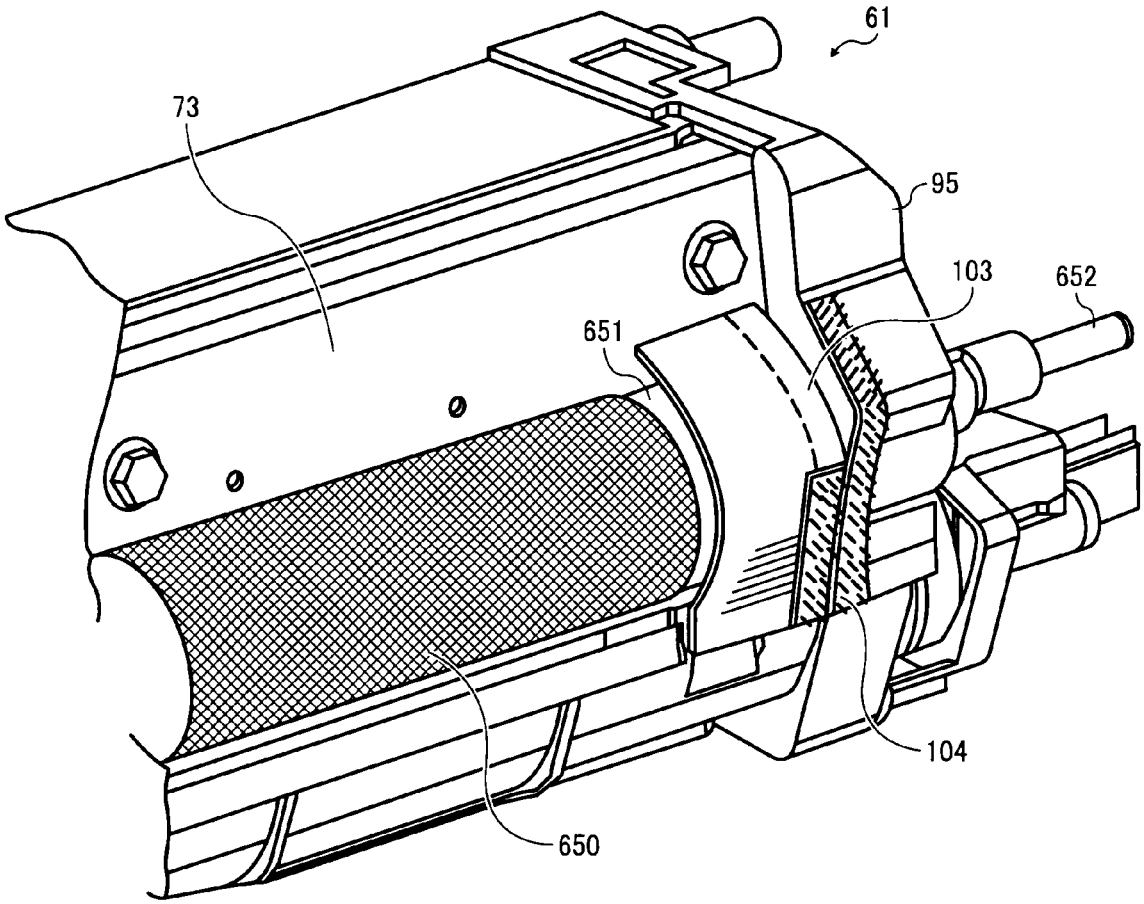
FIG. 1 is an external perspective view illustrating a portion of a developing device including a side protection sheet and a toner dispersion prevention sheet, according to an exemplary embodiment of the present invention.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Exemplary embodiments of the present invention are now described below with reference to the accompanying drawings.

In a later-described comparative example, exemplary embodiment, and alternative example, for the sake of simplicity of drawings and descriptions, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, one example of an image forming apparatus, for example, a tandem-type color electrophotographic copier, according to an exemplary embodiment of the present invention is described with reference to FIG. 11.

The tandem-type image forming apparatus includes a plurality of photoreceptors serving as image bearing members disposed next to each other. Each of the plurality of photoreceptors is provided with a developing device. On the surface of each of the photoreceptors, a single-color toner image of a respective color is formed and transferred overlappingly onto a recording medium, such as a recording sheet or the like. Accordingly, a composite color image is formed on the recording sheet.

The tandem-type image forming apparatus is capable of faster printing speed when compared with a single-drum type image forming apparatus, in which a single photoreceptor repeats image forming operations to create a composite full-color image. However, such a tandem-type image forming apparatus tends to be relatively large.

The tandem-type image forming apparatus according to the exemplary embodiment uses an indirect transfer method, in which a secondary transfer position is located apart from a primary transfer position facing a photoreceptor, thereby making it possible to reduce the overall size of the image forming apparatus. In the indirect transfer method, a sheet feed unit and a fixing unit are overlappingly positioned relative to an image forming portion so as to be able to reduce the size of the image forming unit. The fixing unit is disposed such that there is enough space for a recording sheet to be flexible so that when the recording sheet passes the fixing unit, the image on the recording sheet is not adversely affected.

Figure 11:
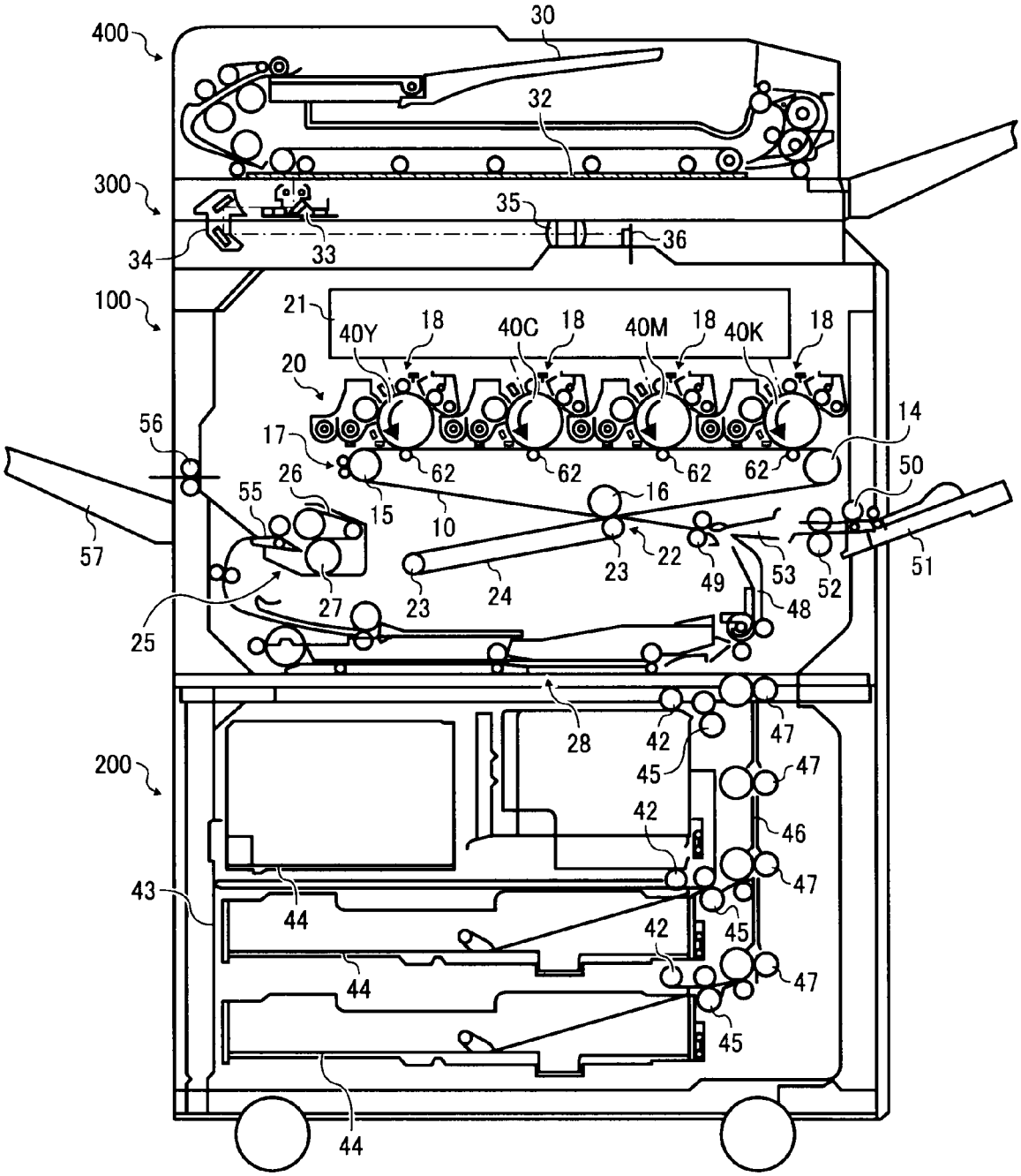
FIG. 11 is a schematic diagram illustrating a tandem-type color copier as an example of an image forming apparatus, according to an exemplary embodiment of the present invention.

Referring now to FIG. 11, there is provided a schematic diagram illustrating a copier as one example of the tandem-type image forming apparatus using the indirect transfer method. The image forming apparatus according to the exemplary embodiment includes at least an image forming unit 100, a sheet feed unit 200, a scanner 300, and an automatic document feeder (ADF) 400.

The image forming unit 100 is disposed substantially above the sheet feed unit 200. The sheet feed unit 200 includes a plurality of sheet feed rollers 42, a paper bank 43 equipped with a plurality of paper cassettes 44, and so forth. The scanner 300 is disposed above the image forming unit 100 and includes a first carriage 33, a second carriage 34, a focusing lens 35, and a reading sensor 36. The ADF 400 is disposed substantially above the scanner 300, and includes a document table 30 and a contact glass 32.

The image forming unit 100 includes an intermediate transfer belt 10 formed of an endless belt serving as an intermediate transfer medium in substantially the center of image forming unit 100. The intermediate transfer belt 10 is formed of a plurality of layers including a base layer, an elastic layer, and a coating layer, in that order from the inner side thereof. The base layer includes material not easily stretched, such as fluororesin, canvas, or the like. The elastic layer includes, for example, fluoro-rubber, Acrylonitrile-Butadiene copolymer rubber, and so forth. The surface of the elastic layer is coated with material having a smooth surface, for example, fluororesin.

The image forming unit 100 includes a first support roller 14, a second support roller 15, and a third support roller 16. The intermediate transfer belt 10 is stretchedly supported by the first support roller 14, the second support roller 15, and the third support roller 16 and rotated in the clockwise direction.

A cleaning unit 17 is provided in the vicinity of the second support roller 15. The cleaning unit 17 is configured to remove toner remaining on the intermediate transfer belt 10 after the image is transferred (hereinafter referred to as residual toner).

Above the intermediate transfer belt 10 wound around the first support roller 14 and the second support roller 15 and stretched between the first support roller 14 and the second support roller 15 are four image forming devices 18 each serving as an image forming mechanism for yellow, cyan, magenta, and black, respectively, horizontally disposed along the conveyance direction of the intermediate transfer belt 10.

Although a detailed description of a tandem image forming unit 20 will be provided later, it is to be noted here that the four image forming devices 18 constitute the tandem image forming unit 20. The tandem image forming unit 20 includes drum-type photoreceptors 40Y, 40C, 40M, and 40K, each serving as a latent image bearing member. Reference characters Y, C, M, and K refer to yellow, cyan, magenta, and black, respectively.

As illustrated in FIG. 11, an exposure unit 21 is provided substantially above the tandem image forming unit 20. A secondary transfer unit 22 is provided on the other side of the tandem image forming unit 20 across from the intermediate transfer belt 10. The secondary transfer unit 22 includes two rollers 23 and a secondary transfer belt 24, which is an endless belt spanned between the two rollers 23. The secondary transfer belt 24 is pressed against the third support roller 16 via the intermediate transfer belt 10, such that the image on the intermediate transfer belt 10 is transferred onto a recording sheet.

In FIG. 11, a fixing device 25 is provided at a side of the secondary transfer unit 22. The fixing device 25 fixes the image transferred onto the recording sheet and includes a fixing belt 26, which is an endless belt, and a pressure roller 27, which presses the fixing belt 26.

The secondary transfer unit 22 described above is equipped with a sheet conveyance mechanism that transports the recording sheet after the image is transferred thereto to the fixing device 25. Alternatively, the secondary transfer unit 22 may include a transfer roller and a non-contact type charger.

Substantially below the secondary transfer unit 22 and the fixing device 25 and parallel to the tandem image forming unit 20 described above, a sheet reversing unit 28 is provided to reverse the recording sheet so as to form an image on both sides of the recording sheet.

Next, a description will be provided of operation of the image forming apparatus. When a document is copied, a user may place the document on the document table 30 of the ADF 400. Alternatively, the user may open or lift the ADF and place the document onto the contact glass 32 of the scanner 300. After placing the document on the contact glass 32, the user may close the ADF 400 which then presses the document.

When the user places the document on the ADF 400 and depresses a start button, not shown, the document is transported onto the contact glass 32. By contrast, when the user directly places the document on the contact glass 32, the scanner 300 is activated immediately so as to operate the first carriage 33 and the second carriage 34.

A light source of the first carriage 33 emits light to illuminate the surface of the document. The light reflected from the document surface is reflected and directed to the second carriage 34. A mirror of the second carriage 34 then reflects and directs the light to the reading sensor 36 through the focusing lens 35. The reading sensor 36 performs photoelectric conversion of the light, thereby reading the context of the document.

When the start button is depressed, a driving motor, not shown, drives and rotates one of the first support roller 14, the second support roller 15, and the third support roller 16. Two other support rollers follow the rotation of the support roller driven by the driving motor. Accordingly, the intermediate transfer belt 10 is rotatively moved.

In the meantime, the photoreceptors 40Y, 40C, 40M, and 40K are rotated in the respective image forming devices 18 so that color images of yellow (Y), cyan (C), magenta (M), and black (K) are each formed on the respective photoreceptors 40Y, 40C, 40M, and 40K. The color images of yellow (Y), cyan (C), magenta (M), and black (K) are sequentially and overlappingly transferred onto the intermediate transfer belt 10 while the intermediate transfer belt 10 is rotated, thereby forming a composite color image thereon.

When the start button is depressed, one of the sheet feed rollers 42 of the sheet feed unit 200 is selected to rotate and picks up a recording sheet from one of the sheet feed cassettes 44 in the paper bank 43.

Separation rollers 45 separate the recording sheets one by one and send the recording sheet to a sheet feed path 46. Sheet conveyance rollers 47 transport and guide the recording sheet to a sheet feed path 48 in the image forming unit 100 until the recording sheet reaches registration rollers 49.

A description is given here of manually feeding the recording sheet. Alternatively, when a recording sheet is fed manually, a sheet feed roller 50 is rotated so as to send the recording sheet on a manual sheet feed tray 51. Then, a separation roller 52 separates the recording sheets one by one and sends the recording sheet to a manual sheet feed path 53 until the recording sheet reaches the registration rollers 49.

Subsequently, the registration rollers 49 are rotated in appropriate timing such that the recording sheet is sent between the intermediate transfer belt 10 and the secondary transfer unit 22, and is aligned with the composite color image on the intermediate transfer belt 10. The composite color image on the intermediate transfer belt 10 is then transferred onto the recording sheet by the secondary transfer unit 22, forming a color image on the recording sheet.

After the image is transferred onto the recording sheet, the secondary transfer unit 22 transports the recording sheet to the fixing unit 25. In the fixing unit 25, heat and pressure are applied to the recording sheet, thereby fixing the transfer image on the recording sheet.

Subsequently, a switching pawl 55 switches the direction of the recording sheet and sends the recording sheet to a sheet discharge roller 56. The sheet discharge roller 56 discharges the recording sheet onto a catch tray 57. The recording sheet is stacked on the catch tray 57.

Alternatively, the switching pawl 55 switches the direction of the recording sheet so as to direct the recording sheet to the sheet reversing unit 28, in which an image is recorded on the other side of the recording sheet.

In the sheet reversing unit 28, the recording sheet is turned over and guided to the transfer position again, and the image is recorded on the other side of the recording sheet. Subsequently, the recording sheet is discharged onto the catch tray 57 by the sheet discharge roller 56.

After the image is transferred, the residual toner remaining on the intermediate transfer belt 10 is cleaned by the cleaning unit 17 in preparation for subsequent image forming operation by the tandem image forming unit 20.

It should be noted that, generally, the registration rollers 49 are grounded. Alternatively, however, the registration rollers 49 may be supplied with a bias voltage in order to remove paper dust from the recording sheet.

Figure 12:
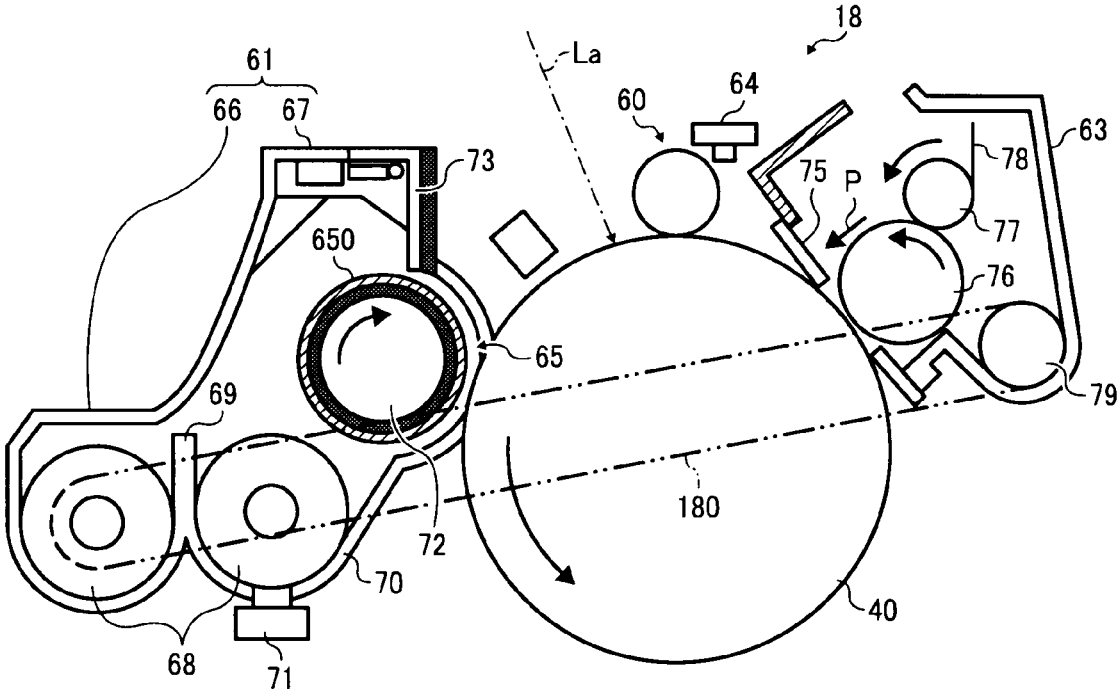
FIG. 12 is a cross-sectional view illustrating an image forming device of the image forming apparatus of FIG. 11, according to an exemplary embodiment of the present invention.

Referring now to FIG. 12, a description is provided of the image forming devices 18 of the tandem image forming unit 20.

FIG. 12 is a schematic diagram illustrating one of the image forming devices 18. It should be noted that each of the image forming devices 18 has a similar if not the same configuration as all the others, except for the color of toner. Thus, the reference characters indicating the color are omitted herein. In addition, to simplify the description, primary transfer devices 62Y, 62C, 62M, and 62K are omitted in FIG. 12.

In FIG. 12, the image forming device 18 includes the drum-type photoreceptor 40 around which are provided a charging device 60, a developing device 61, the primary transfer device 62 (not shown), a photoreceptor cleaning device unit 63, a neutralization device 64, and so forth.

The photoreceptor 40 may include a tube made of aluminum or any other suitable material, to which is applied an organic photosensitive material to form a photosensitive layer. The photoreceptor 40 has a drum shape including the photosensitive layer. Alternatively, however, the photoreceptor 40 may be an endless belt.

Although not illustrated, a process cartridge may include at least the photoreceptor 40 and all or a part of the components constituting the image forming device 18, and may be detachable from the image forming unit 100, thereby facilitating maintenance. Alternatively, the process cartridge may include only the developing device 61 and be detachable from the image forming unit 100, thereby also facilitating maintenance.

The charging device 60 of the image forming device 18 is a roller, and charges the photoreceptor 40 by contacting and applying voltage to the photoreceptor 40. Alternatively, a scorotron charger may be used to charge the photoreceptor 40 without contacting the photoreceptor 40.

The developing devices 61Y, 61C, 61M, and 61K for yellow, cyan, magenta, and black each includes a developing roller 65, an agitation portion 66, a developing portion 67, a screw 68, a doctor blade 73, a housing 70, a cover 70*a* and so forth. The screw 68 serves as a developer agitation/conveyance member. The doctor blade 73 regulates a thickness of the developer on the developing roller 65.

The developing device 61 of each color uses a two-component developer including magnetic carrier and non-magnetic toner. The two-component developer is herein simply referred to as developer.

In the agitation portion 66, the developer is transported and supplied to the developing roller 65 while the developer is agitated. The developer is borne on the developing roller 65. In the developing portion 67, the toner in the developer borne on the developing roller 65 is transferred to the photoreceptor 40, thereby developing the image.

The agitation portion 66 is disposed substantially lower than the developing portion 67 and includes two screws 68 disposed parallel to each other. A separating plate 69 divides the space between the two screws 68. The housing 70 includes a toner density sensor 71.

The developing portion 67 includes the developing roller 65 facing the photoreceptor 40 through the opening of the housing 70. The developing roller 65 includes a magnet roller 72 and a developing sleeve 650. The magnet roller 72 serves as a magnetic field generating member. The developing sleeve 650 is formed of a cylinder member serving as the developer bearing member.

The magnet roller 72 is fixedly disposed inside the developing sleeve 650 and includes a plurality of magnetic poles extending in an axial direction at a predetermined angle. When the developer on the developing sleeve 650 passes a predetermined place, a magnetic force exerted by the magnetic poles of the magnet roller 72 acts on the developer. As the developing sleeve 650 rotates, the developer is transported. The arrangement of the magnetic poles of the magnet roller 72 and the developer regulating member (the doctor blade) together form a developer retaining portion upstream in the developer conveyance direction, where the developer is frictionally charged.

In the vicinity of the tip of the doctor blade 73, a magnetic member, not shown, is provided to regulate the direction of opposing magnetism of the developing roller 65 so as to reduce irregularity in the amount of the developer transported on the developing sleeve 650.

The magnetic roller 72 includes seven magnetic poles from the position opposite to the developing region in the direction of rotation of the developing sleeve 650. The magnetic roller 72 forms a magnetic brush of the developer on the developing sleeve 650 which then carries the magnetic brush.

The two-component developer is mixed and transported by the two screws 68 and supplied to the developer sleeve 650. The developer supplied to the developing sleeve 650 is attracted thereto by the magnet roller 72 so that the magnetic brush of the developer is formed on the developing sleeve 650.

The magnetic brush on the developing sleeve is trimmed to a certain length by the doctor blade 73. The eliminated developer by the doctor blade 73 is returned to the agitation portion 66.

The toner in the developer on the developing sleeve 650 is transferred to the photoreceptor 40 by the developing bias voltage applied to the developing sleeve 650, thereby developing an electrostatic latent image on the photoreceptor 40. Accordingly, a visible image is formed.

After development, at the place where no magnetic force of the magnet roller 72 acts, the developer remaining on the developing sleeve 650 separates from the developing sleeve 650 and recovers to the agitation portion 66. After the above-described developing process is repeatedly performed, when the toner density in the agitation portion 66 decreases, the toner density sensor 71 detects the toner density, and the toner is supplied to the agitation portion 66.

Figure 13:
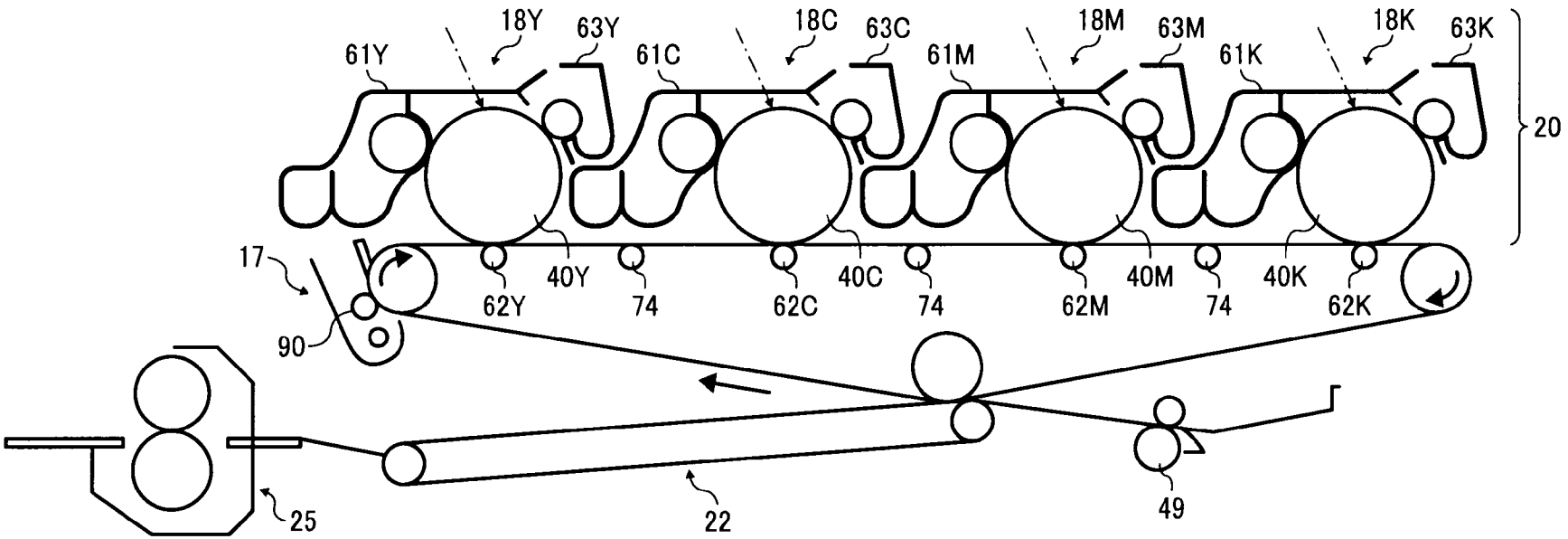
FIG. 13 is a schematic diagram illustrating an image forming mechanism of the image forming apparatus of FIG. 11, according to an exemplary embodiment of the present invention.

As illustrated in FIG. 13, the primary transfer devices 62Y, 62C, 62M, and 62K are rollers and are each pressed against the photoreceptors 40Y, 40C, 40M, and 40K, respectively, across from the intermediate transfer belt 10. However, the primary transfer devices 62Y, 62C, 62M, and 62K are not limited to a roller-type form. The primary transfer devices 62Y, 62C, 62M, and 62K may be a conductive brush or a non-contact type corona charger or the like.

Returning to FIG. 12, the photoreceptor cleaning unit 63 includes a cleaning blade 75, the tip of which is pressed against the photoreceptor 40. The cleaning blade 75 may be formed of polyurethane rubber, for example.

In order to enhance cleaning of the photoreceptor 40, in addition to the cleaning blade 75 the photoreceptor cleaning unit 63 may also use a brush that contacts the photoreceptor 40. In FIG. 12, a fur brush 76 is used, for example. The fur brush 76 is conductive and contacts the peripheral surface of the photoreceptor 40. In FIG. 12, the fur brush 76 contacts the peripheral surface of the photoreceptor 40 while rotating in the direction indicated by an arrow.

The photoreceptor cleaning unit 63 includes an electric field roller 77, a scraper 78, and a recovery screw 79. The electric field roller 77 is formed of metal, rotates in the direction of an arrow, and applies bias voltage to the fur brush 76. The tip of the scraper 78 is pressed against the electric field roller 77. The recovery screw 79 collects the removed toner.

The residual toner remaining on the photoreceptor 40 is removed by the fur brush 76 which rotates in the counter-clockwise direction. The toner adhered to the fur brush 76 is removed by the electric field roller 77 which is supplied with the bias and contacts the fur brush 76 while rotating in a direction counter to the rotation direction of the fur brush 76.

The toner adhered to the electric field roller 77 is removed by the scraper 78. The toner collected by the photoreceptor cleaning unit 63 is collected to one side of the cleaning unit 63 by the recovery screw 79. The toner collected by the recovery screw 79 is returned to the developing device 61 using a toner recycling unit 180 (illustrated in FIG. 12), and is reused.

The neutralization device 64 irradiates the photoreceptor 40 with light so that the surface potential of the photoreceptor 40 is returned to an initial state, in preparation for the next image forming operation.

Along with rotation of the photoreceptor 40, the charging device 60 uniformly charges the surface of the photoreceptor 40. Subsequently, in accordance with the content scanned by the scanner 300, a writing light L of a laser beam or LED is emitted from the exposure unit 21 onto the photoreceptor 40, thereby forming an electrostatic latent image on the photoreceptor 40.

Subsequently, the electrostatic latent image is developed by adhering the toner thereto by the developing device 61 so that a toner image or a visible image is formed. The visible image is transferred onto the intermediate transfer belt 10 by the primary transfer device 62.

After the visible image is transferred, the residual toner remaining on the surface of the photoreceptor 40 is cleaned by the cleaning unit 63, and the neutralization device 64 neutralizes the photoreceptor 40 in preparation for subsequent image forming operation.

It is to be noted that, in FIG. 13, the reference characters Y, M, C, and K indicating colors yellow, magenta, cyan, and black are provided to the tandem image forming units 20, the image forming devices 18, the photoreceptors 40, the primary transfer devices 62, and so forth after the reference numerals.

Referring now to FIG. 13, there is provided a schematic diagram illustrating the tandem image forming unit 20. Although not illustrated in FIGS. 11 and 12, in FIG. 13, a conductive roller 74 is provided between each of the primary transfer devices 62Y, 62C, 62M, and 62K. Each of the conductive rollers 74 contacts the base layer (an inner loop side) of the intermediate transfer belt 10.

Upon transfer of the image, each of the conductive rollers 74 prevents the bias voltage applied by each of the primary transfer devices 62Y through 62K from flowing into the image forming devices 18 nearby through the base layer having medium resistance.

As illustrated in FIG. 13, the cleaning unit 17 includes a fur brush 90 serving as a cleaning member. A predetermined bias voltage is applied to the fur brush 90 by a power source, not shown.

A description will now be given of the toner and carrier particles (magnetic carrier) of the two-component developer used in the developing device 61.

The toner includes resin such as polyether, polyol, and styrene-acrylic into which a charge control agent (CCA) and colorant are blended. The toner further includes an external additive such as silica, titanium oxide and so forth as a fluidity- and charge-enhancing agent.

The diameter of the particles of the external additive is normally in a range of between 0.01 and 1.5 μm. The colorant includes carbon black, phthalocyanine blue, quinacridone, and carmine, for example.

The toner is negatively charged. The toner may include mother toner particles, in which wax is dispersed and blended. The mother toner particles include the external additives described above. The toner is prepared using a pulverization method according to the exemplary embodiment. Alternatively, the toner may be prepared using a polymerization method.

Generally, the toner prepared by the polymerization method, a heating method, or the like, is able to have a shape factor of greater than or equal to 90%. Furthermore, the coverage of the additives tends to be relatively high.

It is desirable that a volume average particle diameter of the toner be between 3 and 12 μm. According to the exemplary embodiment, the volume average particle diameter of the toner is approximately 6 μm so as to be able to accommodate a high-resolution image of greater than or equal to 1200 dpi.

The magnetic particles include magnetic material such as ferrite or the like having a metal or resin core covered with silicone resin or the like. It is desirable that the particle diameter be in a range of between 20 and 50 μm. The optimum dynamic resistance value of the magnetic particles is in a range of between $10^4$ and $10^6\Omega$.

The dynamic resistance value is measured by the following method. The magnetic particles are borne on a roller (ϕ20, 600 RPM) including a magnet therein. An electrode having a width of approximately 65 mm and a length of approximately 1 mm is configured to contact the roller. A gap of approximately 0.9 mm is provided between the roller and the electrode. A voltage of maximum level of pressure resistance is applied, and the dynamic resistance value is measured. When high-resistance silicone coating carrier particles are measured, a voltage of approximately 400V is applied. When iron-powder carrier particles are measured, several volts are applied.

The magnetic carrier includes ferrite serving as a core member. The ferrite includes a resin component in which a thermoplastic resin, such as acrylic resin and melamine resin, are cross-linked, to which a charge adjusting agent is added.

With the above-described developer including the carrier with a relatively firm and strong coating layer and the developing sleeve with a plurality of the V-shape grooves, it is possible to achieve a developing device that achieves both high-speed imaging and high-quality images.

In order to achieve high-quality images, it is preferable that the particle diameter of the magnetic carrier particles in the developer be relatively small. For example, when the diameter of the carrier particles is greater than or equal to 50 μm, the granularity is approximately 0.3 in a halftone dot image of brightness between 70 and 90.

By contrast, when the diameter of the carrier particles is reduced to approximately 35 μm, the granularity is approximately 0.1. Thus, in order to achieve a high-quality image, it is preferable to use the carrier having a small particle diameter.

Furthermore, in order to maintain a high-quality image, it is necessary to consistently maintain a supply amount of the developer, that is, an amount of the developer ρ passing the doctor blade, and suppress degradation of the developer.

The amount of the developer supplied and degradation of the developer are affected by the distribution of magnetic force of the magnetic poles of the magnet roller 72 facing the doctor blade 73, the surface structure of the developing sleeve, and the surface structure of the developer.

Due to abrasion between the surface of the developing sleeve and the coating layer of the developer the amount of the developer being supplied is reduced over time, thereby causing uneven images.

Conventionally, the surface of the developing sleeve includes a plurality of grooves (recessed portions) extending in the width direction of the developing sleeve (in a longitudinal direction of the shaft.) Alternatively, the surface of the developing sleeve may be finished by sandblasting, for example.

When using the developing sleeve including the grooves, the distance between the grooves and the photoreceptor surface differs from the distance between the non-groove portions and the photoreceptor surface in the developing region, causing the developing electric field to vary.

Furthermore, even if the granularity is improved by using the above-described carrier having a relatively small particle diameter, abrasion of the coating layer of the developer over time decreases the amount of the developer being supplied, thereby causing uneven image density.

Such abrasion of the developer causes a conveyance property of the developer to deteriorate, particularly since, as the rotation speed of the developing sleeve, such as the developing sleeve 650 used in the developing device in the high-speed tandem type image forming apparatus, increases, abrasion is accelerated.

In view of the above, the developing sleeve 650 includes the V-shape grooves so that stable conveyance of the developer can be achieved. However, when the V-shape grooves provide good conveyance of the developer at each of both ends of the developing sleeve 650, the magnetic force of the magnet roller 72 in the developing sleeve 650 is concentrated at both ends thereof, causing the developer to flow into the end portions of the image forming area of the developing sleeve 650.

Consequently, the density of the developer rises at both ends of the image forming region in a width direction on the developer sleeve 650, thereby increasing developer pressure between the photoreceptor and the developing sleeve.

As a result, the developer may firmly stick to the surface of the developing sleeve and/or the developer may drop from each of both ends of the developer sleeve. When the developer firmly sticks to the surface of each of both ends of the developer sleeve, problems such as peeling of the surface layer of the photoreceptor, background contamination of an image at both ends in the width direction, banding, cleaning failure, and so forth may occur in the image forming apparatus.

In addition, such problems are more pronounced when the developer has a small particle diameter and a developing gap Gp is relatively small.

According to the exemplary embodiment, as illustrated in FIG. 1, the outer diameter of both ends of the developing sleeve 650 (also referred to as a region without V-shape grooves) is configured to be smaller than that of the center portion of the developing sleeve 650 (also referred to as a region including V-shape grooves).

When the outer diameter of both ends of the developing sleeve 650 is configured to be smaller than that of the center portion of the developing sleeve 650, both ends of the developing sleeve can be formed by a relatively simple process such as cutting both ends after drawing out a base tube.

Figure 2:
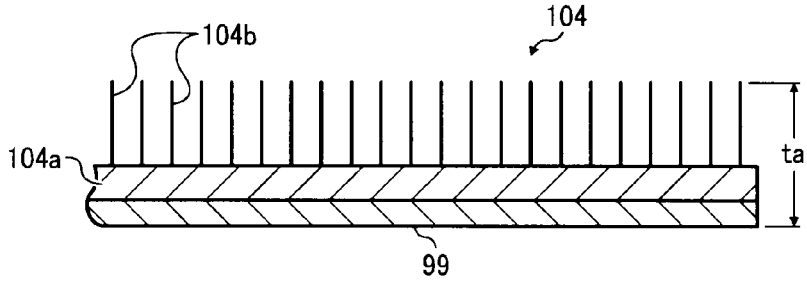
FIG. 2 is a schematic diagram illustrating the toner dispersion prevention sheet of FIG. 1, according to an exemplary embodiment of the present invention.
Figure 3:
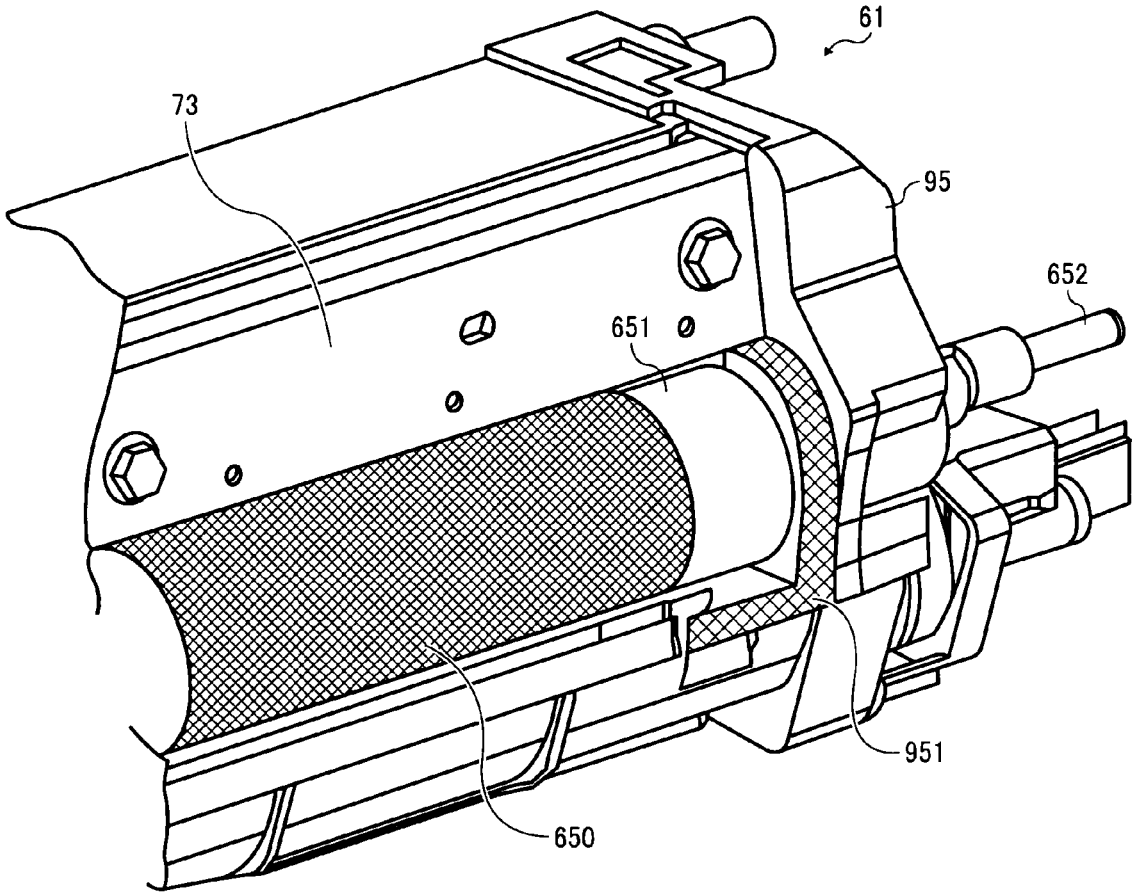
FIG. 3 is an external perspective view illustrating a surface of the developing device to which the side protection sheet and the toner dispersion prevention sheet are provided, according to an exemplary embodiment of the present invention.

With reference to FIGS. 1 through 3, a description will be provided of an exemplary embodiment of a present invention. FIGS. 1 and 3 are enlarged perspective views illustrating the developing device 61 and a rear portion of the image forming apparatus 100. FIG. 2 is a conceptual diagram illustrating a toner dispersion prevention sheet 104.

Unlike the related-art developing device illustrated in FIGS. 11 through 13, the developing device 61 includes a side protection sheet 103 and the toner dispersion prevention sheet 104 provided at both end portions 651 of the developing sleeve 650 in the width direction of the developing sleeve 650, disposed opposite to the photoreceptor 40. Each of the side protection sheets 103 serves as a shock absorbing member. Each of the toner dispersion prevention sheets 104 protects the toner from getting dispersed outside.

The end portions 651 refer to a step portion formed at both ends of the developing sleeve 650, having an outer diameter substantially smaller than the outer diameter of the center portion of the developing sleeve 650. The center portion of the developing sleeve 650 includes the image creating region corresponding to the image forming region of the photoreceptor 40.

As illustrated in FIG. 3, a sheet adhering surface 951 indicated by hatching is provided on side housing walls 95 at both sides of the housing of the developing device 61. As illustrated in FIG. 1, the side protection sheet 103 serving as the shock absorbing member and the toner dispersion prevention sheet 104 are adhered to the sheet adhering surface 951 of the side housing walls 95 at both sides of the developing device 61.

Each of the toner dispersion prevention sheets 104 is adhered to the side protection sheet 103 using double sided tape 99 illustrated in FIG. 2. Since the toner dispersion prevention sheet 104 is sub-assembled with the side protection sheet 103, only the side protection sheet 103 needs to be accurately adhered to the sheet adhering surface 951. Accordingly, operation is made easier for an operator.

The side protection sheet 103 is formed of a relatively thin sheet and adhered to the sheet adhering surface 951 using the double sided tape. The material of the side protection sheet 103 may be a flexible material such as a polyurethane rubber sheet or a polyester film, so that the shape of the side protection sheet 103 can be changed in accordance with the shape of each end portion 651 of the developing sleeve 650, thereby facilitating adhering operation by the user.

Still further, the sheet member made of polyurethane rubber or polyester film demonstrates relatively good slidability and elasticity. Thus, even if the side protection sheet 103 contacts the developing sleeve 650 and the photoreceptor 40, it does not damage the developing sleeve 650 and the photoreceptor 40.

It is to be noted that a hardness of the polyurethane rubber sheet is approximately 92 Hs (JIS K6253). The hardness of the polyester film sheet is similar to, if not the same hardness as, the polyurethane rubber sheet. Compared to the organic photosensitive layer of the photoreceptor 40, the polyurethane rubber sheet and the polyester film sheet is substantially softer. Therefore, the photosensitive layer of the photoreceptor 40 is not damaged.

Furthermore, the polyurethane rubber sheet and the polyester film sheet can be obtained easily and at low price. Therefore, the polyurethane rubber sheet and the polyester film sheet are suitable material for the side protection sheet 103.

The side protection sheet 103 is fixedly provided to each end portion 651 of the developing sleeve 650, that is, the end portion having a smaller outer diameter than the center of the developing sleeve 650.

As illustrated in FIG. 2, each of the toner dispersion prevention sheets 104 includes Teflon® fibers 104*b* implanted on a ground fabric 104*a* and is conventionally used. The ground fabric 104*a* is formed of a pile fabric, and a very thin double-sided tape is adhered to the bottom of the ground fabric 104*a*.

It is preferable that a thickness ta of the toner dispersion prevention sheet 104 be approximately 1 mm. When the thickness is greater than 1 mm, toner dispersion is not optimally prevented.

According to the exemplary embodiment, when the toner dispersion prevention sheet 104 includes the Teflon fibers 104*b*, the toner can be captured by the Teflon fibers 104*b*, thereby preventing toner dispersion.

As described above, the toner dispersion prevention sheet 104 is attached to the side protection sheet 103 in advance. The side protection sheet 103 including the toner dispersion prevention sheet 104 is adhered to both end portions 651 of the developing sleeve 650, thereby reducing, if not preventing entirely, toner dispersion and damage to the photoreceptor by the side protection sheet 103 as will be later described.

Figure 4:
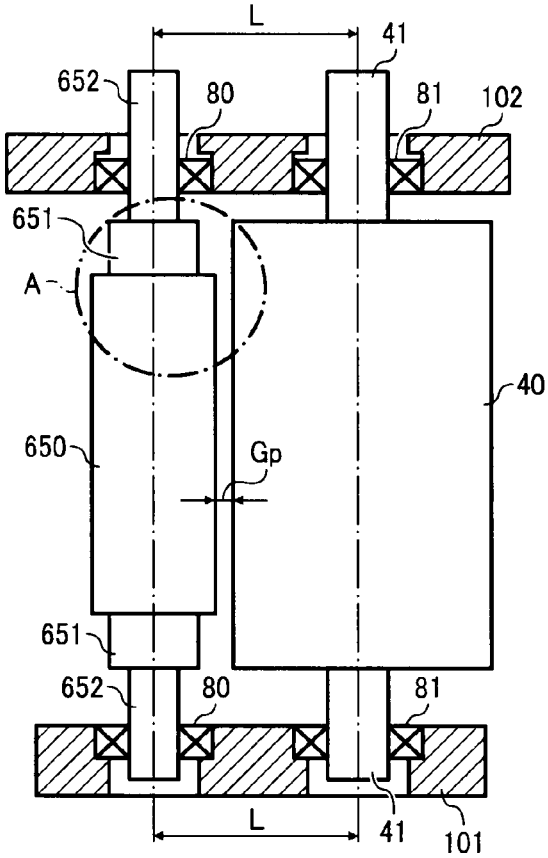
FIG. 4 is a cross-sectional view illustrating a method for positioning a developing sleeve and a photoreceptor, according to an exemplary embodiment of the present invention.
Figure 5:
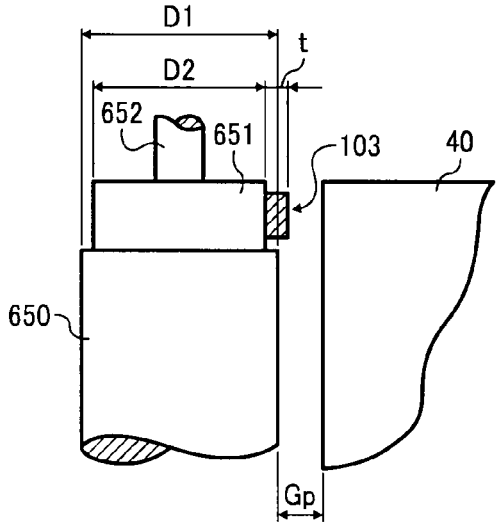
FIG. 5 is an enlarged cross-sectional view of a portion A of FIG. 4, according to an exemplary embodiment of the present invention.

With reference to FIGS. 4 through 7, a description is provided of a thickness of the side protection sheet 103. FIG. 4 is a cross sectional view illustrating the developing sleeve 650 and the photoreceptor 40 for explaining a method for positioning the developing sleeve 650 and the photoreceptor 40. FIG. 5 is an enlarged view illustrating a portion A of FIG. 4.

In FIG. 4, the photoreceptor 40 includes a shaft 41 fixed to both end surfaces of the photoreceptor 40. The shaft 41 is rotatably mounted to a pair of plate members 101 and 102 through shaft bearings 81. A gear or the like (not shown) is provided at one end of the shaft 41 and rotatably drives the shaft 41. A shaft 652 of the developing sleeve 650 is rotatably held by the plate members 101 and 102 through shaft bearings 80.

As illustrated in FIG. 4, a distance L between the center of a shaft 652 of the developing sleeve 650 and the center of the shaft 41 of the photoreceptor 41 is secured, and a gap Gp of a certain width is consistently secured as well.

In FIGS. 4 and 5, D1 is an outer diameter of the center portion of the developing sleeve 650, D2 is an outer diameter of the end portion 651, t is the thickness of the side protection sheet 103, and Gp is the gap between the center portion of the surface of the photoreceptor 40 and the center portion of the surface of the developing sleeve 650.

Figure 6:
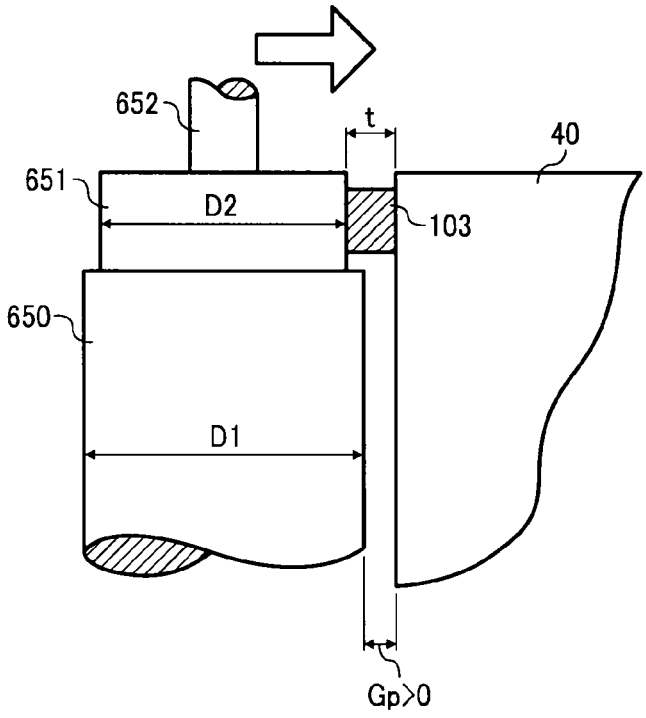
FIG. 6 is an enlarged cross-sectional view illustrating an example of the side protection sheet of FIG. 1, in which a thickness t of the side protection sheet is substantially thick.

Referring now to FIG. 6, there is provided an enlarged cross-sectional view illustrating an example of the side protection sheet 103 when the side protection sheet 103 is substantially higher than the center portion of the developing sleeve 650.

When the side protection sheet 103 is relatively thick as illustrated in FIG. 6, before installation of the plate members 101 and 102 the developing sleeve 650 is prevented from contacting the photoreceptor 40 as the developing sleeve 650 approaches the photoreceptor 40.

Figure 7:
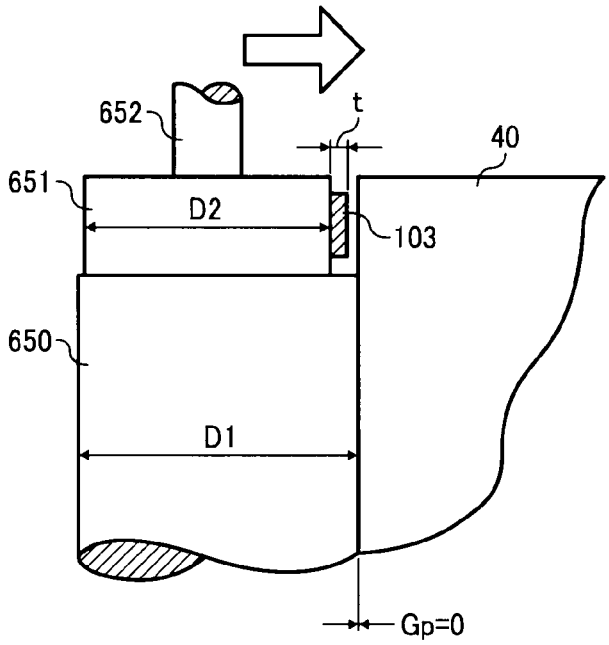
FIG. 7 is an enlarged cross-sectional view illustrating a comparative example of the side protection sheet, in which a thickness t of the side protection sheet is substantially thin.

By contrast, FIG. 7 illustrates an example in which the side protection sheet 103 is substantially lower than the center portion of the developing sleeve 650, that is, the side protection sheet 103 is relatively thin. In this case, the developing sleeve 650 may contact the photoreceptor 40 before installation of the plate members 101 and 102.

Therefore, it is desirable to implement a configuration illustrated in FIG. 6, and the thickness of the side protection sheet 103 can be expressed as follows:

$$t>(D1-D2)/2 \quad (1)$$

Such a configuration enables the developing sleeve 650 to be prevented from contacting the photoreceptor 40 during assembly and transportation. However, when the side protection sheet 103 is too thick, a later-described difficulty may occur due to a rotation frictional force of the developing sleeve 650 and the photoreceptor 40 as a normal image forming operation is performed.

Figure 8:
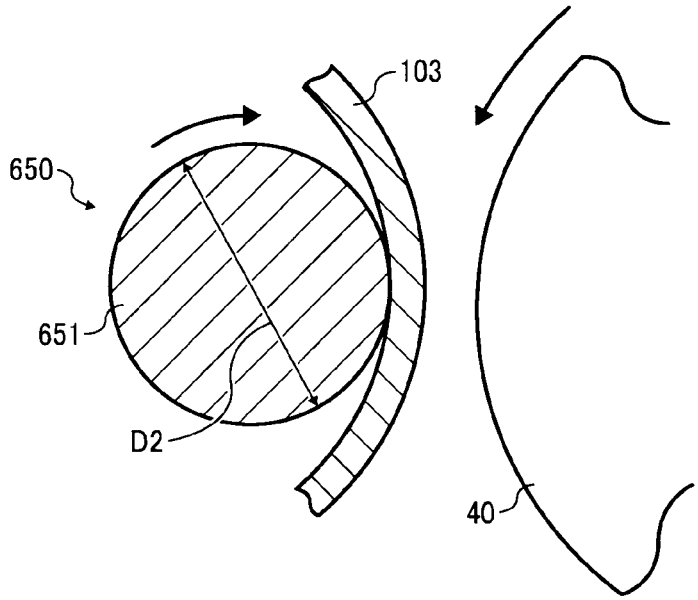
FIG. 8 is an enlarged cross-sectional view illustrating an example of the side protection sheet in which inadvertent rolling of the side protection sheet does not occur.
Figure 9:
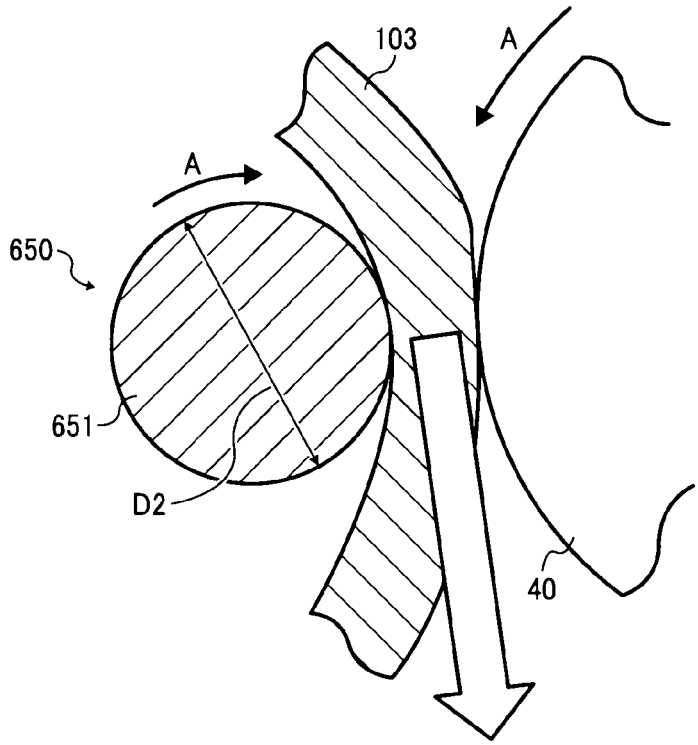
FIG. 9 is an enlarged cross-sectional view illustrating a comparative example of the side protection sheet when inadvertent rolling of the side protection sheet occurs.
Figure 10:
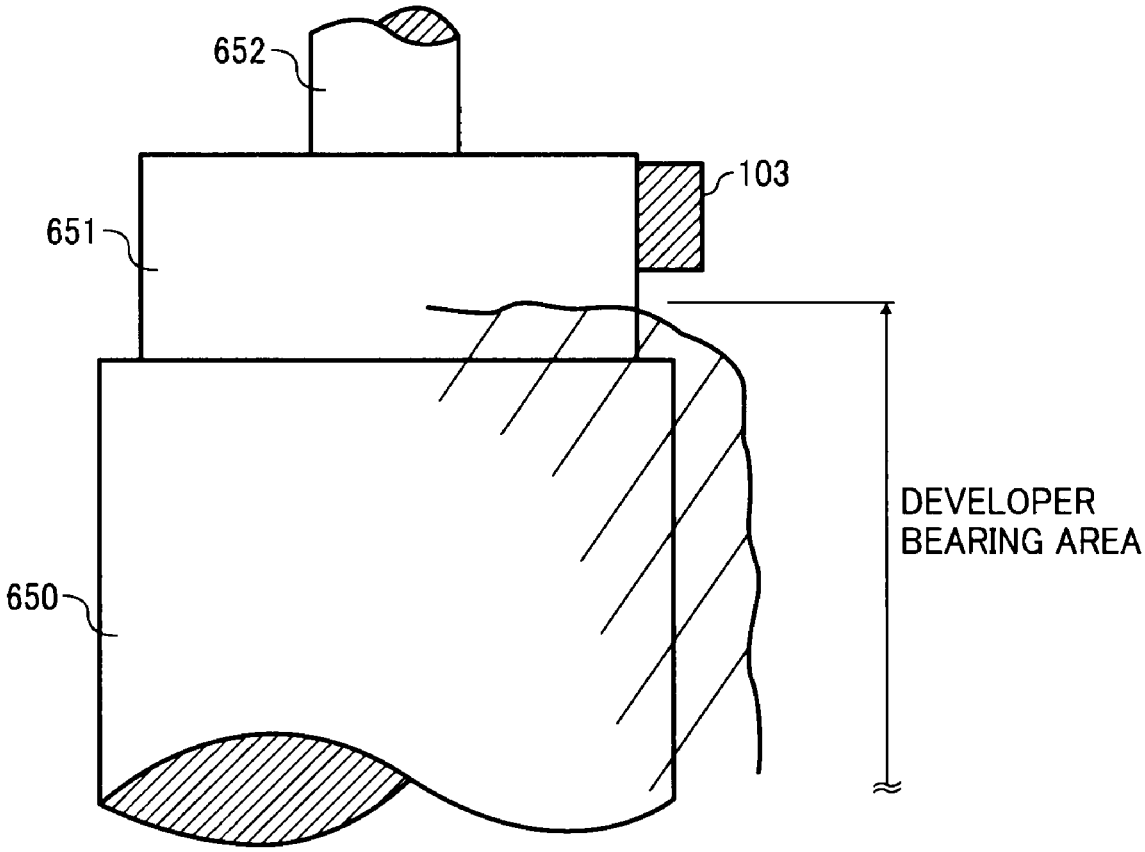
FIG. 10 is an enlarged cross-sectional view illustrating the side protection sheet provided at an end portion of the developing sleeve outside a developer bearing area, according to an exemplary embodiment of the present invention.

Referring now to FIGS. 8 and 9, there are provided cross-sectional views illustrating schematically the end portion 651 of the developing sleeve 650.

FIG. 9 illustrates one example of the side protection sheet 103, when the side protection sheet 103 is too thick. As illustrated in FIG. 9, when the side protection sheet 103 is too thick, the side protection sheet 103 is inadvertently nipped between the surface of the end portion 651 of the developing sleeve 650 and the photoreceptor 40. Consequently, when the developing sleeve 650 and the photoreceptor 40 rotate in the direction of arrows A in FIG. 9, the rotary frictional force causes the side protection sheet 103 to be stretched in a downward direction indicated by a hollow arrow. As a result, inadvertent rolling of the side protection sheet 103 occurs.

By contrast, FIG. 8 illustrates one example of the side protection sheet 103, when the side protection sheet 103 is not too thick. As illustrated in FIG. 8, the side protection sheet 103 is not too thick, and thus, the side protection sheet 103 does not get caught between the surface of the end portion 651 of the developing sleeve 650 and the photoreceptor 40. Accordingly, inadvertent rolling of the side protection sheet 103 can be prevented when the developing sleeve 650 and the photoreceptor 40 rotate in the arrow-A direction.

Therefore, it is desirable to implement a configuration illustrated in FIG. 8, and the thickness of the side protection sheet 103 can be expressed as follows:

$$t<Gp+(D1-D2)/2 \quad (2)$$

In order to prevent the photoreceptor 40 from getting damaged and inadvertent rolling of the side protection sheet 103, the following relation is satisfied:

$$(D1-D2)/2<t<Gp+(D1-D2)/2 \quad (3)$$

Even if the equation 2 is satisfied, there is a possibility that when the developer, particularly, the magnetic carrier slips between the side protection sheet 103 and the developing sleeve 650, the developing sleeve 650 may be damaged and/or the developer may firmly stick thereto. Therefore, it is desirable that the side protection sheet 103 be provided to substantially an outer side of the developer bearing area of the developing sleeve 650, that is, relatively an end of the end portion 651.

Now, results of experiments for evaluating an image forming apparatus according to exemplary embodiments and comparative examples are described.

Figure 14A:
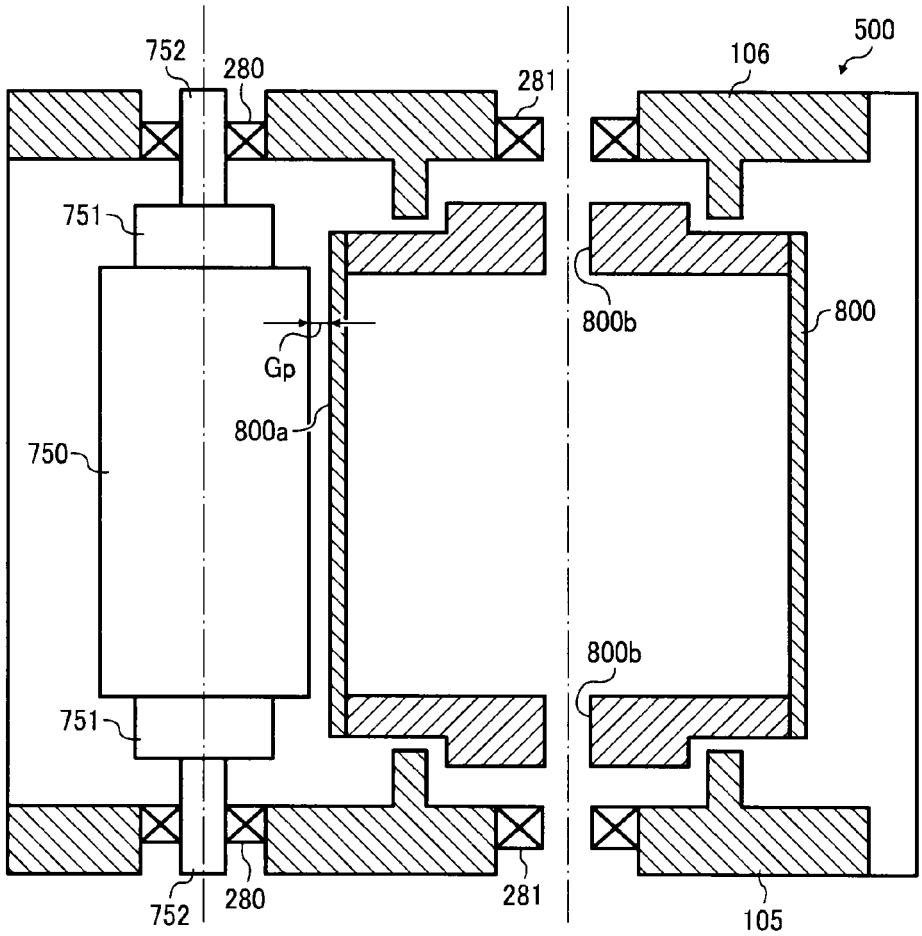
FIG. 14A RELATED ART
FIG. 14A is a cross-sectional view illustrating a developing sleeve and a photoreceptor, according to a related art.
Figure 14B:
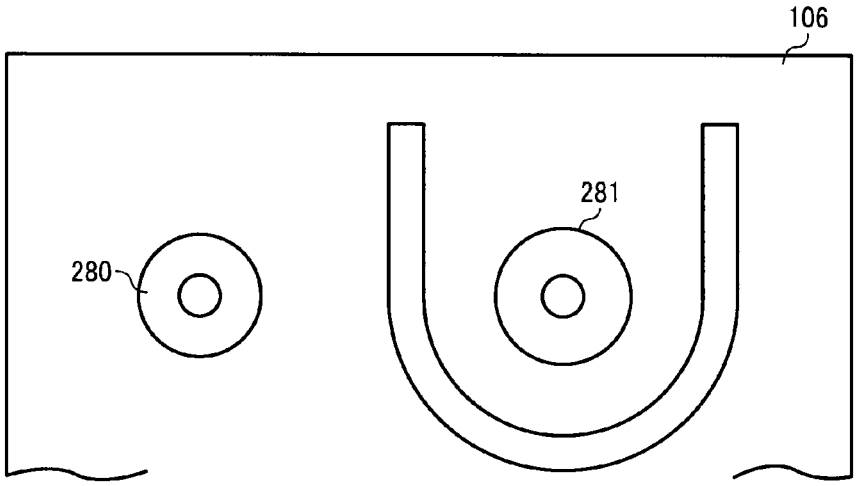
FIG. 14B RELATED ART
FIG. 14B is a side view illustrating a supporting plate including shaft bearings illustrated in FIG. 14A, according to a related art.
Figure 15:
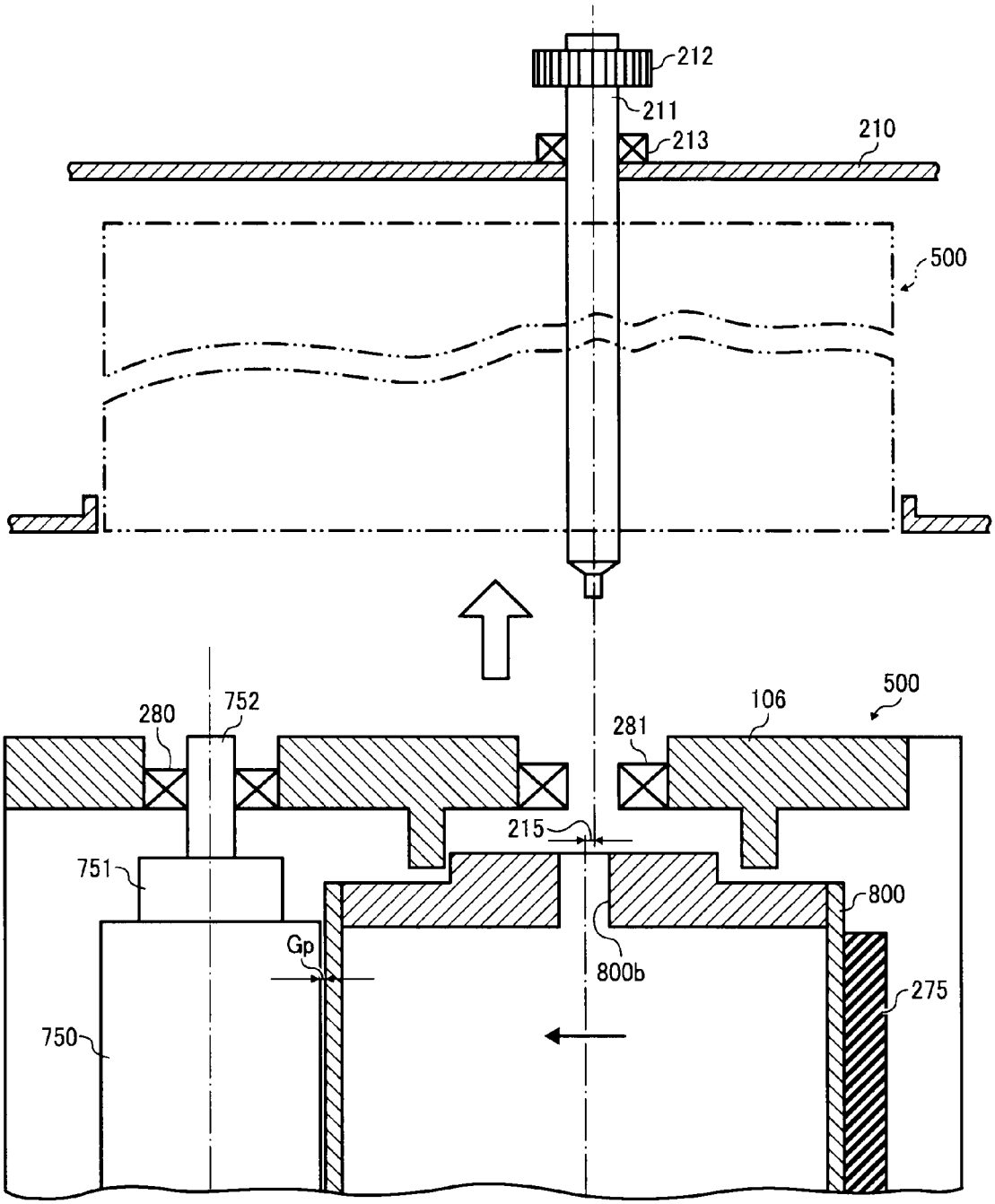
FIG. 15 RELATED ART
FIG. 15 is a conceptual diagram illustrating a plan view of a method for positioning the developing sleeve and the photoreceptor of FIG. 14, according to a related art.

Experiments were performed to evaluate damage to the photoreceptor 40, inadvertent rolling of the side protection sheet 103, and toner dispersion using an experimental image forming apparatus in which the structure illustrated in FIGS. 1 through 3 was implemented. A similar positioning and driving method for the photoreceptor 40 as that illustrated in FIGS. 14 and 15 was used in the experimental image forming apparatus.

Exemplary Embodiment 1

The experiment was performed under the following conditions:

Gap Gp (developing gap): 0.3 mm

Outer diameter D1 of the center portion of the developing sleeve 650: ϕ 25 mm Outer diameter D2 of the end portion 651 of the developing sleeve 650: ϕ 24.8 mm Thickness t of the side protection sheet 103: 0.2 mm Material for the side protection sheet 103: Polyurethane rubber Surface condition of the developing sleeve 650 (Depth of the V-shape grooves): 0.15 mm Amount of the developer supplied: 40 mg/cm$^2$

[Experiment Result]

An optimum result was achieved. No damage was observed on the photoreceptor 40, and no inadvertent rolling of the side protection sheet 103 occurred. Furthermore, when compared with the developing sleeve 650 without the side protection sheet 103, an optimum result of the toner dispersion was also achieved.

Exemplary Embodiment 2

The experiment was performed under the following conditions:

Gap Gp (developing gap): 0.25 mm

Outer diameter D1 of the center portion of the developing sleeve 650: ϕ 16 mm Outer diameter D2 of the end portion 651 of the developing sleeve 650: ϕ 15.9 mm Thickness t of the side protection sheet 103: 0.1 mm Material for the side protection sheet 103: Polyester film Surface condition of the developing sleeve 650: Surface finish by sandblasting (JIS Ten-point mean roughness Rz of 13 μm)

Amount of the developer supplied: 40 mg/cm$^2$

[Experiment Result]

An optimum result was achieved. No damage was observed on the photoreceptor 40, and no inadvertent rolling of the side protection sheet 103 occurred. Furthermore, when compared with the developing sleeve 650 without the side protection sheet 103, an optimum result of the toner dispersion was also achieved.

Exemplary Embodiment 3

The experiment was performed under the similar conditions as that of the exemplary embodiment 1, except that the thickness t of the side protection sheet 103 was changed between 0.1, 0.2, and 0.3 mm, and an amount of the developer supplied was changed between 30, 40, and 50 mg/cm$^2$. Table 1 shows the result of the experiment.

In Table 1, F refers to the front of the developing sleeve 650 and the photoreceptor 40, that is, the bottom side of FIG. 4. R refers to the rear of the developing sleeve 650 and the photoreceptor 40, that is, the top of FIG. 4. The symbol ○ indicates that the results were acceptable, Δ indicates that the side protection sheet 103 was deformed, and X indicates that the photoreceptor 40 was damaged.

TABLE 1

| AMOUNT OF DEVELOPER SUPPLIED | t = 0.1 mm | | t = 0.2 mm | | t = 0.3 mm | |
|---|---|---|---|---|---|---|
| [mg/cm$^2$] | X | X | ○ | ○ | ○ | Δ |
| 30 | X | X | ○ | ○ | ○ | Δ |
| 40 | X | X | ○ | ○ | ○ | Δ |
| 50 | X | X | ○ | ○ | ○ | Δ |

As can be seen from Table 1, when the thickness t of the side protection sheet 103 was greater than or equal to 0.3 mm, the side protection sheet 103 was deformed. It is to be noted that deformation of the side protection sheet 103 eventually leads to inadvertent rolling of the side protection sheet 103.

By contrast, when the thickness t of the side protection sheet 103 was approximately 0.1 mm, the photoreceptor 40 was damaged.

Therefore, it is preferable that the thickness t of the side protection sheet 103 be in a range of greater than 0.1 mm and less than 0.3 mm (0.1 mm<t<0.3 mm).

When the thickness t of the side protection sheet 103 was less than 0.3 mm (t<0.3 mm), deformation and inadvertent rolling of the side protection sheet 103 did not occur, as indicated by the relation expressed by the equation 2.

Furthermore, the side protection sheet 103 was provided outside the developer bearing area. Thus, the amount of the developer supplied did not cause failure in the side protection sheet 103.

Although the front and rear structures of the developing sleeve 650 and the photoreceptor 40 are symmetrically configured, Table 1 shows that when the thickness t of the side protection sheet 103 was 0.3 mm, the side protection sheet 103 at the rear side was deformed. Machine variation is assumed to be the cause.

According to the exemplary embodiments described above, consistent transport of the developer is secured in the imaging region, and the developer is prevented from sticking firmly to the surface of the developer bearing member in the developing region due to increase in the developer pressure at both ends of the developer bearing member in the width direction. Furthermore, the developer sleeve is prevented from contacting the photoreceptor, thereby preventing the photoreceptor from getting damaged, and thus preventing image defect.

The foregoing description pertains to a shock absorbing member provided to both ends of a developer bearing member used in a developing device, an image forming apparatus, or a process cartridge using a two-component developer.

The shock absorbing member is provided to both end portions of the developer bearing member having an outer diameter smaller than an outer diameter of the center portion thereof facing the image forming region of the image bearing member. Accordingly, the image bearing member can be protected from damage using a member having a simple configuration.

The present invention can be implemented in a developing device, an image forming apparatus, and a process cartridge using a one-component developer. When the outer diameter of both end portions of the developer bearing member is not smaller than the outer diameter of the center portion of the developer bearing member facing the image forming region on the image bearing member, both end portions of the developer bearing member can be simply machine-processed to have a smaller outer diameter. Accordingly, the present invention can be implemented.

It is to be noted that elements and/or features of different exemplary embodiments may be combined with each other and/or substituted for each other within the scope of this disclosure and appended claims.

Moreover, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Example embodiments being thus described, it will be obvious that the same may be varied in many ways. Such exemplary variations are not to be regarded as a departure from the spirit and scope of the present invention, and all such modifications as would be obvious to one skilled in the art are intended to be included within the scope of the following claims.

What is claimed is:

1. A developing device, comprising:

a developer bearing member including a developing region across from an image bearing member including an image forming region, and a center portion including an image creating region corresponding to the image forming region of the image bearing member, the developer bearing member configured to bear a developer on a surface thereof and transport the developer to the developing region while moving the surface; and a shock absorbing member provided to each of both ends of the developer bearing member in a width direction thereof across from the image bearing member, wherein both ends of the developer bearing member are provided outside the center portion of the developer bearing member, and an outer diameter of both ends of the developer bearing member are substantially smaller than an outer diameter of the center portion thereof, and wherein the shock absorbing member is fixed to side housing walls of the developing device and is configured to contact only one of the developer bearing member and the image bearing member during image formation.

2. The developing device according to claim 1, wherein the following relation is satisfied:

$$t>(D1-D2)/2,$$

where t is a thickness of the shock absorbing member, D1 is the outer diameter of the center portion of the developer bearing member, and D2 is the outer diameter of the each of both ends of the developer bearing member.

3. The developing device according to claim 1, wherein the following relation is satisfied:

$$t<Gp+(D1-D2)/2,$$

where Gp is a gap between the image bearing member and the center portion of the developer bearing member, t is a thickness of the shock absorbing member, D1 is the outer diameter of the center portion of the developer bearing member, and D2 is the outer diameter of the each of both ends of the developer bearing member.

4. The developing device according to claim 1, wherein the following relation is satisfied:

$$(D1-D2)/2<t<Gp+(D1-D2)/2,$$

where Gp is a gap between the image bearing member and the center portion of the developer bearing member, t is a thickness of the shock absorbing member, D1 is the outer diameter of the center portion of the developer bearing member, and D2 is the outer diameter of the each of both ends of the developer bearing member.

5. The developing device according to claim 1, wherein the shock absorbing member is provided outside a developer bearing portion of the developer bearing member.

6. The developing device according to claim 1, wherein the shock absorbing member is formed of a flexible material.

7. The developing device according to claim 1, wherein the shock absorbing member is formed of polyurethane rubber.

8. The developing device according to claim 1, wherein the shock absorbing member is formed of polyester film.

9. The developing device according to claim 1, wherein a thickness of the shock absorbing member is between 0.1 and 0.3 mm.

10. The developing device according to claim 1, wherein the shock absorbing member is a sheet wrapped around the each of both ends of the developer bearing member.

11. The developing device according to claim 1, wherein the shock absorbing member is provided only on a surface of the developer bearing member facing the image bearing member.

12. An image forming apparatus, comprising:

an image bearing member configured to bear a latent image on a surface thereof;

a latent image forming device configured to form the latent image on the image bearing member;

a transfer device configured to transfer a toner image on the image bearing member onto a transfer medium; and a developing device configured to develop the latent image on the image bearing member, the developing device including:

a developer bearing member including a developing region across from an image bearing member including an image forming region, and a center portion including an image creating region corresponding to the image forming region of the image bearing member, the developer bearing member configured to bear a developer on a surface thereof and transport the developer to the developing region while moving the surface; and a shock absorbing member provided to each of both ends of the developer bearing member in a width direction thereof across from the image bearing member, wherein both ends of the developer bearing member are provided outside the center portion of the developer bearing member, and an outer diameter of both ends of the developer bearing member are substantially smaller than an outer diameter of the center portion thereof, and wherein the shock absorbing member is fixed to side housing walls of the developing device and is configured to contact only one of the developer bearing member and the image bearing member during image formation.

13. A process cartridge detachable from an image forming apparatus, comprising:

an image bearing member configured to bear a latent image on a surface thereof; and a developing device configured to develop the latent image on the image bearing member, the developing device including:

a developer bearing member including a developing region across from an image bearing member including an image forming region, and a center portion including an image creating region corresponding to the image forming region of the image bearing member, the developer bearing member configured to bear a developer on a surface thereof and transport the developer to the developing region while moving the surface; and a shock absorbing member provided to each of both ends of the developer bearing member in a width direction thereof across from the image bearing member, wherein both ends of the developer bearing member are provided outside the center portion of the developer bearing member, and an outer diameter of both ends of the developer bearing member are substantially smaller than an outer diameter of the center portion thereof, and wherein the shock absorbing member is fixed to side housing walls of the developing device and is configured to contact only one of the developer bearing member and the image bearing member during image formation.

* * * * *